US009624880B2

(12) United States Patent
Ito

(10) Patent No.: US 9,624,880 B2
(45) Date of Patent: Apr. 18, 2017

(54) INTAKE SYSTEM OF INTERNAL COMBUSTION ENGINE

(71) Applicant: Toyota Jidosha Kabushiki Kaisha, Toyota-shi, Aichi-ken (JP)

(72) Inventor: Hirokazu Ito, Susono (JP)

(73) Assignee: Toyota Jidosha Kabushiki Kaisha, Toyota-shi (JP)

( * ) Notice: Subject to any disclaimer, the term of this patent is extended or adjusted under 35 U.S.C. 154(b) by 72 days.

(21) Appl. No.: 14/847,649

(22) Filed: Sep. 8, 2015

(65) Prior Publication Data

US 2016/0069305 A1 Mar. 10, 2016

(30) Foreign Application Priority Data

Sep. 9, 2014 (JP) ..... 2014-183166

(51) Int. Cl.
*F02M 27/04* (2006.01)
*F02M 35/10* (2006.01)
*F02M 69/04* (2006.01)

(52) U.S. Cl.
CPC .... *F02M 27/042* (2013.01); *F02M 35/10281* (2013.01); *F02M 69/044* (2013.01)

(58) Field of Classification Search
CPC ..... F02M 27/042; F02M 35/10281; F02M 35/10118; F02M 35/10301; F02M 69/044; F02B 27/02
USPC .. 123/298, 301, 308, 184.56, 345–348, 536, 123/537, 539
See application file for complete search history.

(56) References Cited

U.S. PATENT DOCUMENTS 8,941,291 B2 * 1/2015 Kim ..... B62D 35/00 123/536
2012/0152198 A1 6/2012 Kim et al.
2016/0215709 A1 * 7/2016 Ito ..... F02D 33/006

FOREIGN PATENT DOCUMENTS

| | | | |
|---|---|---|---|
| JP | 2011-047320 | A | 3/2011 |
| JP | 2011-142025 | A | 7/2011 |
| JP | 2012-180799 | A | 9/2012 |
| JP | 2013-108469 | A | 6/2013 |
| JP | 2013-155673 | A | 8/2013 |
| JP | 2014-001691 | A | 1/2014 |
| WO | 2011024736 | A1 | 3/2011 |

* cited by examiner

*Primary Examiner* — Hai Huynh
(74) *Attorney, Agent, or Firm* — Dinsmore & Shohl LLP

(57) ABSTRACT

The present invention provides an intake system of an internal combustion engine. A plasma actuator is provided in a region which is on an inner wall surface of an intake passage and to which fuel injected from a fuel injection valve adheres. The plasma actuator is disposed so as to generate an airflow in a predetermined direction not including a component in a direction toward a downstream side of the intake passage at the time of its operation. A control unit is configured to control the plasma actuator so as to actuate the plasma actuator in at least a part of a period from start of fuel injection by the fuel injection valve to start of valve opening of an intake valve.

6 Claims, 9 Drawing Sheets

INTAKE SYSTEM OF INTERNAL COMBUSTION ENGINE

CROSS-REFERENCES TO RELATED APPLICATIONS

This application claims the benefit of Japanese Patent Application No. 2014-183166, filed Sep. 9, 2014, which is hereby incorporated by reference wherein in its entirety.

BACKGROUND OF THE INVENTION

Field of the Invention

The present invention relates to an intake system of an internal combustion engine and, in particular, to an intake system of an internal combustion engine including a plasma actuator provided in an intake passage.

Description of the Related Art

For example, in an internal combustion engine for a vehicle, there is known an intake system including a fuel injection valve that injects fuel to an intake passage. In this case, fuel injected from the fuel injection valve adheres to an inner wall surface of the intake passage.

Japanese Patent Laid-Open No. 2014-001691 discloses that in order to suppress adhesion of injected fuel to an inner wall surface of an intake passage and to promote vaporization of the fuel, gas (an air) is supplied from a gas supply mechanism toward a portion to which the injected fuel adheres in the inner wall surface of the intake passage.

By the way, usually, fuel injection from the fuel injection valve is started before valve opening of the intake valve, i.e., during valve closing. In that case, the fuel injected from the fuel injection valve to adhere to the inner wall surface of the intake passage tends to flow down along the inner wall surface of the intake passage, and to be accumulated in a concave portion sandwiched between the inner wall surface of the intake passage and the intake valve. The accumulated fuel flows into a combustion chamber in a cylinder at once at the time of valve opening of the intake valve. Accordingly, there is a problem that the fuel having become comparatively large droplets vaporizes in the combustion chamber, and thus vaporization of the fuel is delayed, and as a result, much HC as unburned fuel is discharged.

This is particularly remarkable at the time of cold operation of the internal combustion engine. It is because at the time of cold operation, a temperature of the inner wall surface of the intake passage is low, and thus vaporization of adhesion fuel by receiving heat from the inner wall surface of the intake passage is apt to be insufficient.

Note that since the gas supply mechanism described in Japanese Patent Laid-Open No. 2014-001691 supplies high-pressure gas to a portion to which injected fuel adheres from an upstream side of the portion, the supplied high-pressure gas may wash away the adhesion fuel to a downstream side to thereby promote the above-described problem.

Consequently, the present invention has been devised in view of the above-described circumstances, and an object thereof is to provide an intake system of an internal combustion engine that can prevent fuel injected from a fuel injection valve to adhere to an inner wall surface of an intake passage from going to a downstream side of the intake passage.

SUMMARY OF THE INVENTION

According to one aspect of the present invention, there is provided an intake system of an internal combustion engine including:

a fuel injection valve that injects fuel to an intake passage;

a plasma actuator provided in a region which is on an inner wall surface of the intake passage and to which the fuel injected from the fuel injection valve adheres; and a control unit configured to control the plasma actuator, wherein the plasma actuator is disposed so as to generate an airflow in a predetermined direction not including a component in a direction toward a downstream side of the intake passage at the time of its operation, and wherein the control unit controls the plasma actuator so as to actuate the plasma actuator in at least a part of a period from start of fuel injection by the fuel injection valve to start of valve opening of an intake valve.

According to the present invention, there is exhibited an excellent effect that can prevent the fuel injected from the fuel injection valve to adhere to the inner wall surface of the intake passage from going to the downstream side of the intake passage.

Further features of the present invention will become apparent from the following description of exemplary embodiments (with reference to the attached drawings).

DESCRIPTION OF THE EMBODIMENTS

Hereinafter, embodiments according to the present invention will be explained based on accompanying drawings.

First Embodiment

Figure 1:
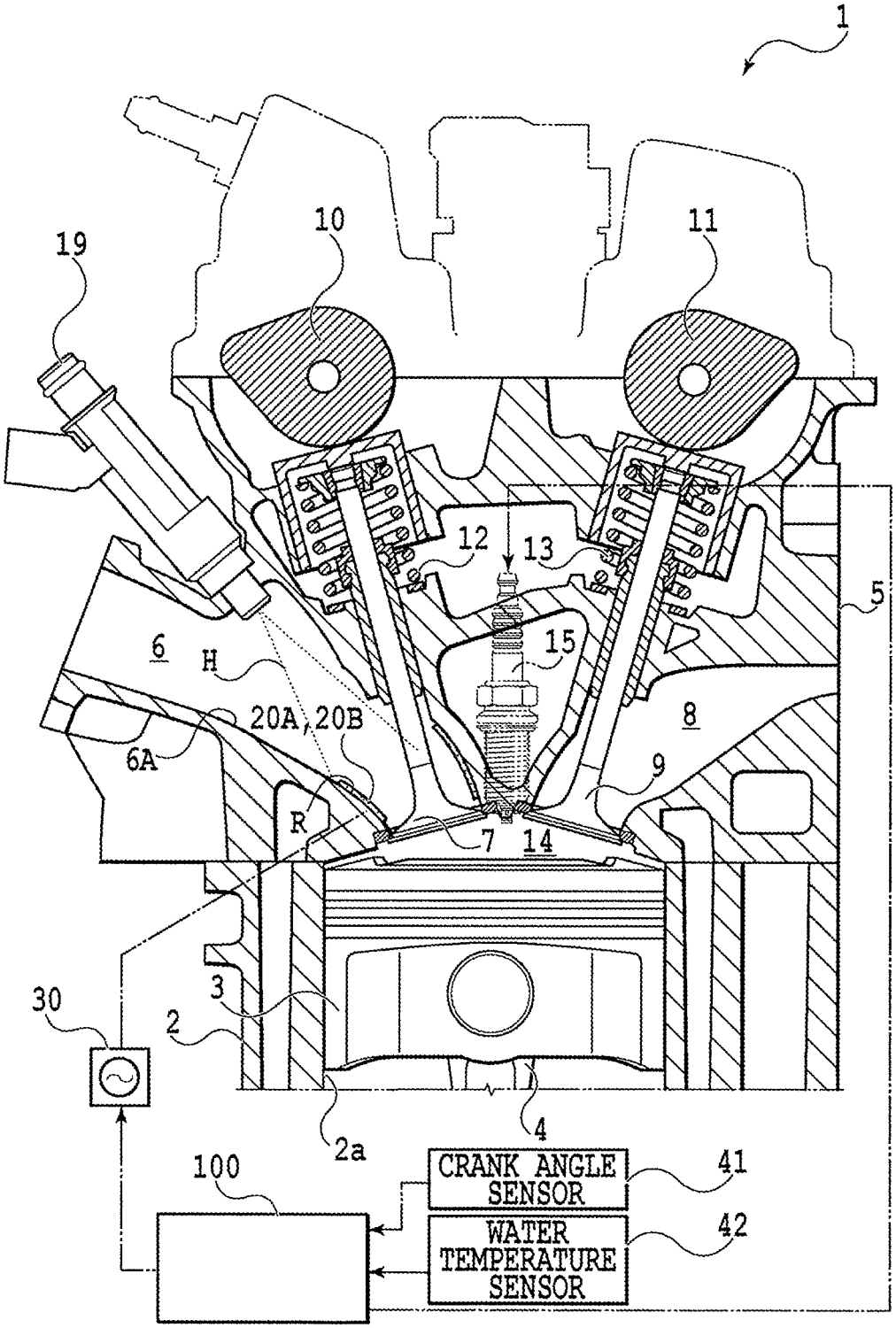
FIG. 1 is a schematic cross-sectional view showing a configuration of a first embodiment according to the present invention.

A configuration of the embodiment will be schematically shown in FIG. 1. An internal combustion engine (an engine) 1 is mounted on a vehicle, and is configured as a multi-cylinder (only one cylinder is illustrated) spark ignition type internal combustion engine (a gasoline engine). However, a type of engine, the number of cylinders, a cylinder disposition form (in-line, V-type, horizontally-opposed, etc.), an ignition type, etc. are not particularly limited, and, for example, the engine may be a compression ignition type internal combustion engine (a diesel engine). A type of vehicle, an application, etc. are not particularly limited, and, for example, the vehicle may be a usual vehicle having the engine 1 as an only power source, or may be a hybrid vehicle including two power sources of the engine 1 and an electric motor. In the embodiment, an electronic control unit (hereinafter referred to as an ECU) 100 as a control unit configured to control the vehicle and the engine is provided.

A piston 3 is reciprocatably housed in a cylinder 2*a* formed in a cylinder block 2 of the engine 1, and the piston 3 is coupled to a crankshaft (not illustrated) through a connecting rod 4. An intake port 6 forming a part of an intake passage, and an exhaust port 8 forming a part of an exhaust passage are defined in a cylinder head 5 of the engine 1, respectively. An outlet 6B (refer to FIG. 6) of the intake port 6 is opened and closed by an intake valve 7, and an inlet of the exhaust port 8 is opened and closed by an exhaust valve 9, respectively. The intake valve 7 and the exhaust valve 9 are always biased in a valve closing direction by an intake valve spring 12 and an exhaust valve spring 13, respectively, and are driven in a valve opening direction by an intake camshaft 10 and an exhaust camshaft 11, respectively. The camshafts 10, 11 are coupled to the crankshaft via a power transmission mechanism. A spark plug 15 for igniting an air-fuel mixture present in a combustion chamber 14 in the cylinder 2*a* is attached to a top portion of the cylinder head 5. Note that a variable valve mechanism (for example, a variable valve timing mechanism) for changing valve opening characteristics of at least one of the intake valve 7 and the exhaust valve 9 may be provided.

An intake manifold or branch pipes (not illustrated) that forms a part of the intake passage is connected to an upstream side of the intake port 6. A surge tank (not illustrated), which is an intake air collection chamber, is connected to an upstream side of the branch pipes, and it also forms a part of the intake passage. The "intake passage" is a general term of a passage through which an intake air flows. Similarly, the "exhaust passage" is a general term of a passage through which an exhaust air flows.

A fuel injection valve (an injector) 19 that injects fuel to the intake passage, particularly to the intake port 6 is attached to the cylinder head 5. As illustrated, the fuel injection valve 19 is disposed so as to inject fuel H in a sprayed manner from an upper part and the upstream side of the intake port 6 toward a lower part and a downstream side thereof, and toward the outlet 6B (refer to FIG. 6) of the intake port 6. In addition, the fuel injection valve 19 is disposed so as to make the fuel H directly collide against the lower inner wall surface 6A located just in front of the outlet of the intake port 6 in the inner wall surface 6A of the intake port 6. Here, the fuel H made to collide against the lower inner wall surface 6A adheres to a collision position, and splashes to adhere also to sides of the collision position and the upper inner wall surface 6A. In addition, since fuel injection is performed during valve closing of the intake valve 7, the injected fuel H collides against the intake valve 7 to adhere thereto, and splashes to adhere to a whole circumference of the inner wall surface 6A just in front of the intake port outlet 6B.

Such a region on the inner wall surface 6A of the intake port 6 against which or to which the injected fuel H from the fuel injection valve 19 collides or adheres is called a "fuel adhesion region" for convenience, and is denoted by a symbol R. As illustrated, a portion in front of the outlet of the intake port 6 is inclined obliquely downward toward the intake port outlet 6B, is curved downward from the upstream side toward the downstream side, and a cross-sectional shape of the portion is substantially circular. Accordingly, the fuel adhesion region R is also inclined obliquely downward toward the intake port outlet 6B, and is formed as a cylindrical region curved downward from the upstream side toward the downstream side. Particularly in the fuel adhesion region R, the lower inner wall surface 6A of the intake port 6 is inclined obliquely downward.

The spark plug IS and the fuel injection valve 19 are electrically connected to the ECU 100, and are controlled by the ECU 100. In addition, a crank angle sensor 41 for detecting a crank angle of the engine 1, and a water temperature sensor 42 for detecting a coolant temperature of the engine 1 are electrically connected to the ECU 100.

Particularly, in the embodiment, a first plasma actuator 20A and a second plasma actuator 20B are provided in the fuel adhesion region R, and a power supply device 30 for supplying electrical energy to these plasma actuators 20A, 20B is provided. The power supply device 30 is also electrically connected to the ECU 100. By controlling the power supply device 30, the ECU 100 changes magnitude of the electrical energy supplied to the plasma actuators 20A, 20B from the power supply device 30, and switches operation states of the plasma actuators 20A, 20B.

Here, the plasma actuators 20A, 20B of the embodiment will be explained. Note that since a plasma actuator itself is known, explanations of basic matters, such as an operation principle, will be mostly omitted here. Since configurations of the first plasma actuator 20A and the second plasma actuator 20B are substantially similar to each other, the first plasma actuator 20A will be first explained in detail, and the second plasma actuator 20B will be next explained focusing on a difference from the first plasma actuator 20A.

Figure 2:
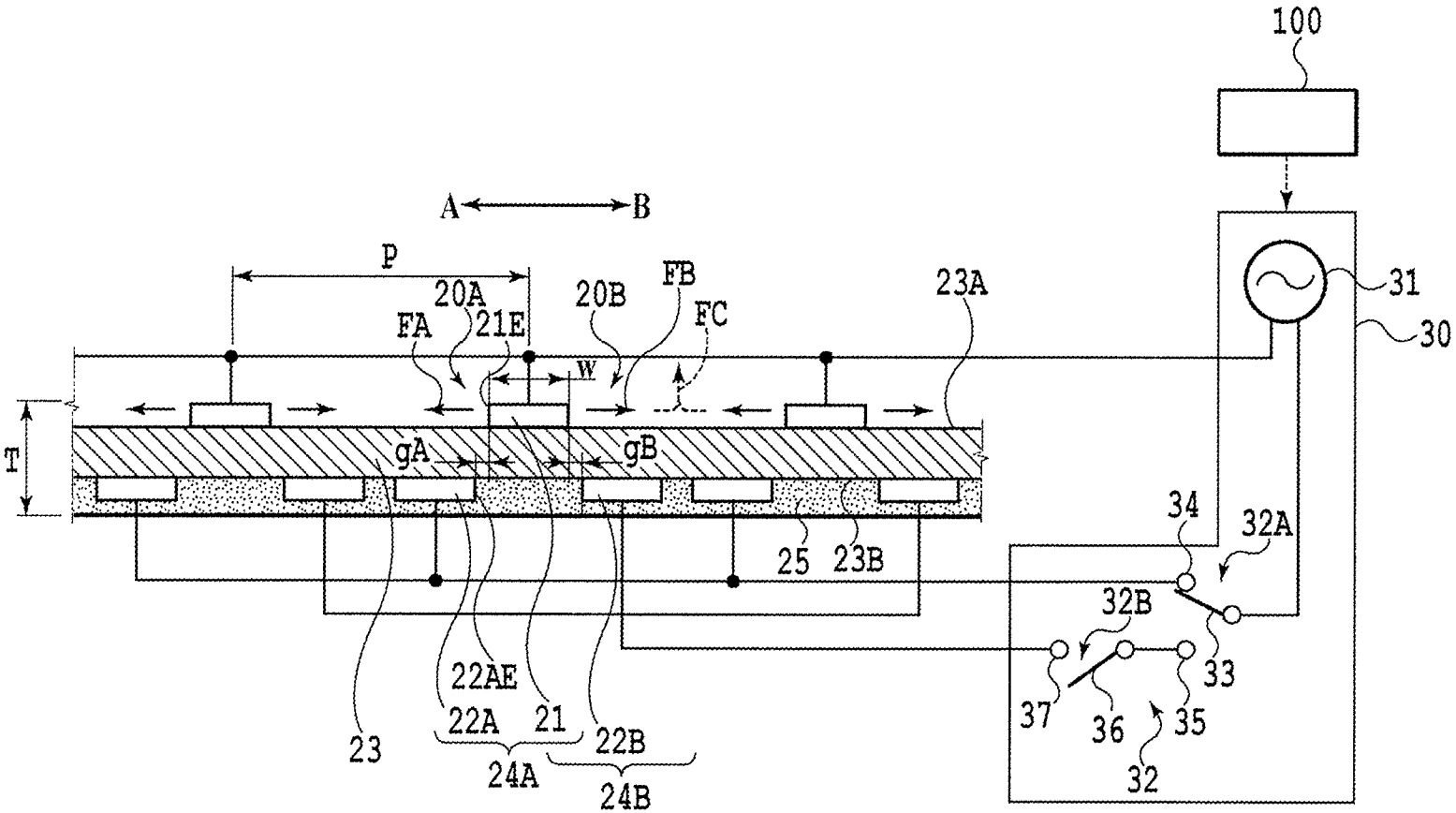
FIG. 2 is a cross-sectional view of a plasma actuator.

As shown in FIG. 2, the first plasma actuator 20A is configured to have a plurality of first electrode units 24A each including: a pair of electrodes including a front surface electrode 21 and a first back surface electrode 22A; and a thin plate-like dielectric 23 disposed between the pair of electrodes. The front surface electrode 21 and the dielectric 23 are common to the first and second plasma actuators 20A, 20B.

The first back surface electrodes 22A are aligned in an A direction (a direction toward a left side in FIG. 2) as illustrated being offset with respect to the front surface electrode 21, and a gap gA in the A direction is formed between opposing-side edges 21E and 22AE of the both electrodes. Additionally, the plurality of first electrode units 24A is aligned at a regular interval by a predetermined pitch P in the A direction. The A direction, which is an alignment direction of the front surface electrodes 21 and the first back surface electrodes 22A, and is an alignment direction of the first electrode units 24A, is also called a "first alignment direction".

Now, assume that electrical energy, specifically a high AC (alternating-current) voltage was applied between the front surface electrode 21 and the first back surface electrode 22A. In that case, plasma is generated near the opposing-side edge 21E of the front surface electrode 21, and near the surface 23A of the dielectric 23, a drive force (a blowing force) that makes an air flow in the A direction from the front surface electrode 21 side toward the first back surface electrode 22A side is generated due to the plasma, and an airflow in the A direction as shown by FA is generated on the surface 23A of the dielectric 23. The airflow FA is generated in a region extremely near (approximately 1 to 2 mm) from the surface 23A of the dielectric 23. Such an airflow is called an "actuator airflow" for convenience.

Note that although there are various theories on a principle of generation of such an airflow, according to a theory, for example, when the front surface electrode 21 has a positive potential, an insulation breakdown of the air occurs near the surface 23A of the dielectric 23, thereby ionization is caused, and weakly ionized plasma is generated. Since mobility of electrons is high, the electrons move to the front surface electrode 21 in an extremely short time. In that case, positive ions become excessive, and an electrostatic force is generated by applied electrolysis. The electrostatic force received by the ions is transmitted to neutral particles by collision. When this is seen from a viewpoint of a continuous fluid, a body force (the blowing force) is generated in its space. There is a theory that oxygen negative ions play a large role in the generation of the blowing force in the same direction also when the front surface electrode 21 has a negative potential.

The first plasma actuator 20A is installed so that a front surface portion at which the front surface electrode 21 is installed faces an inside of a gas passage in which the airflow is desired to be generated, i.e., an inside of the intake port 6. On the other hand, since it is not necessary to generate the airflow at a back surface portion of the first plasma actuator 20A, and the back surface portion rather serves as an adhesion surface to the intake port inner wall surface 6A, the first back surface electrode 22A is embedded in an insulating layer 25 formed on a back surface 23B of the dielectric 23 in order to electrically insulate the first back surface electrode 22A. The insulating layer 25 is also common to the first and second plasma actuators 20A, 20B. Note that since the dielectric 23 is formed of a resin-based or a ceramic-based insulating material, the first back surface electrode 22A may be embedded in the dielectric 23.

Since each of the first electrode units 24A generates the airflow FA in the A direction as mentioned above, the first plasma actuator 20A as a whole generates the airflow in the A direction over a wide range on its surface, i.e., a first actuator airflow.

As shown in FIG. 2, the second plasma actuator 20B has a configuration opposite to that of the first plasma actuator 20A. The second plasma actuator 20B is configured to have a plurality of second electrode units 24B each including: a pair of electrodes including the front surface electrode 21 and a second back surface electrode 22B; and the dielectric 23 disposed between the pair of electrodes.

The second back surface electrodes 22B are aligned in a B direction (a direction toward a right side in FIG. 2) opposite to the A direction being offset with respect to the front surface electrodes 21, and a gap gB in the B direction is formed between opposing-side edges of the both electrodes. Additionally, the plurality of second electrode units 24B is aligned at a regular interval by the predetermined pitch P in the B direction. The B direction, which is an alignment direction of the front surface electrodes 21 and the second back surface electrodes 22B, and is an alignment direction of the second electrode units 24B, is also called a "second alignment direction".

When an AC voltage is applied between the front surface electrode 21 and the second back surface electrode 22B, an airflow in the B direction as shown by FB is generated on the surface 23A of the dielectric 23. Accordingly, the second plasma actuator 20B as a whole generates the airflow in the B direction over a wide range on its surface, i.e., a second actuator airflow.

The first plasma actuator 20A and the second plasma actuator 20B are configured to be symmetrical to a center of a width w of the front surface electrode 21, and are integrally configured by arranging the front surface electrode 21, and the first and second back surface electrodes 22A, 22B at the common dielectric 23. Either of the airflow FA in the A direction and the airflow FB in the B direction can be selectively generated by actuating either of the plasma actuators.

The power supply device 30 includes: a common power supply 31 for applying an AC voltage to the first and second plasma actuators 20A, 20B; and a switch 32 interposed between the first and second plasma actuators 20A, 20B and the power supply 31. Here, the plurality of front surface electrodes 21 are connected to each other, and are connected to the power supply 31. The plurality of first back surface electrodes 22A are also connected to each other, and the plurality of second back surface electrodes 22B are also connected to each other.

The power supply 31 changes an output voltage based on a command signal from the ECU 100. The AC voltage output from the power supply 31 is, for example, a high voltage of approximately 1 to 10 kV, and has a frequency of approximately 1 to 10 kHz. Note that a DC (direct-current) pulse voltage may be output instead of the AC voltage. Not only magnitude of drive forces generated by the plasma actuators 20A, 20B, but strength of the airflow can be changed by changing a voltage value output from the power supply 31, i.e., by changing magnitude of the voltages applied to the plasma actuators 20A, 20B. The higher-value voltages are applied, the larger the strength of the airflows generated by the plasma actuators 20A, 20B becomes. Note that although it is also considered that a frequency of the voltage is changed in addition to or instead of the magnitude of the voltage in order to change the airflow strength, only the magnitude of the voltage will be changed for convenience here.

By using the power supply 31 common to both the plasma actuators 20A, 20B, the number of power supplies is minimized, and cost can be reduced.

The switch 32 is switched based on the command signal from the ECU 100, thereby an operation state of each plasma actuator is switched, and generation states of a first and a second airflow are switched.

The switch 32 has a first switch 32A and a second switch 32B. The first switch 32A has a movable contact 33 and two fixed contacts 34, 35, and the second switch 32B has a movable contact 36 and one fixed contact 37. The movable contact 33 is connected to the power supply 31. The fixed contact 34 is connected to the plurality of first back surface electrodes 22A. The fixed contact 37 is connected to the plurality of second back surface electrodes 22B. The fixed contact 35 is connected to the movable contact 36.

When the movable contact 33 is connected to the fixed contact 34 (an illustrated state), only the first plasma actuator 20A is set to be the operation state (on), and the airflow in the A direction is generated. When the movable contact 33 is connected to the fixed contact 35, and the movable contact 36 is connected to the fixed contact 37, only the second plasma actuator 20B is set to be the operation state, and the airflow in the B direction is generated. When the movable contact 33 is connected to the fixed contact 35, and the movable contact 36 is disconnected from the fixed contact 37, both plasma actuators are set to be non-operation states, i.e., they are turned off.

Note that a configuration of the switch 32 is arbitrary, and that the switch 32 may have a mechanical contact, or may be configured by an electric switching circuit.

A thickness T of the plasma actuator is extremely thin, and it is an order of several μm to several hundreds μm (the electrodes etc. in FIG. 2 are exaggeratingly depicted). Accordingly, even when the plasma actuator is installed on the inner wall surface 6A of the intake port 6, it does not substantially prevent a flow of the intake air.

The first and second plasma actuators 20A, 20B extend in the A direction or the B direction, and the respective electrodes 21, 22A, 22B extend in a direction (a paper thickness direction of FIG. 2) perpendicular to the A direction or the B direction. A lead electrode that connects the same kinds of electrodes to each other is provided at one end in a longitudinal direction of the respective electrodes.

Figure 3:
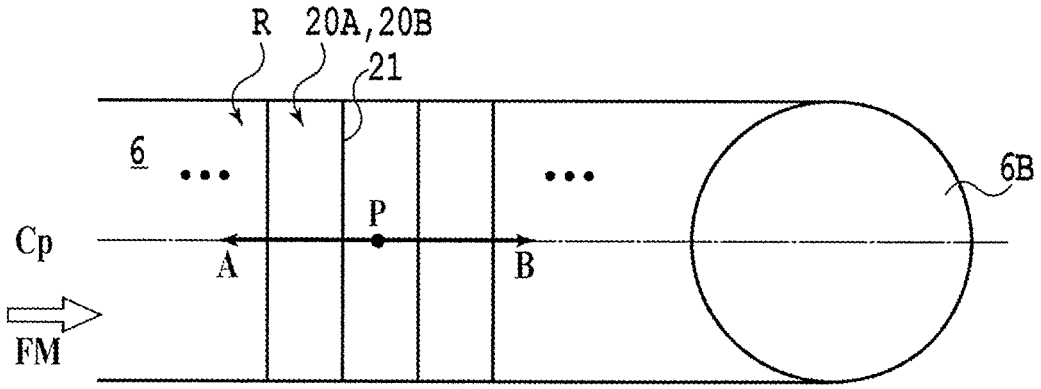
FIG. 3 is a schematic development view depicting a lower portion of a fuel adhesion region.

Returning to FIG. 1, the first and second plasma actuators 20A, 20B are disposed in the fuel adhesion region R so that the first alignment direction A extends toward the upstream side of the intake port 6, and that the second alignment direction B extends toward the downstream side of the intake port 6. This appearance is schematically shown in FIG. 3. FIG. 3 is a schematic development view depicting a lower portion of the fuel adhesion region R, and in FIG. 3, the first and second plasma actuators 20A, 20B are abbreviated to be shown only as the front surface electrode 21 shown by a continuous line. The reference character 68 denotes the outlet of the intake port 6. A reference character Cp denotes a longitudinal axis or a longitudinal direction of the intake port 6, and an intake air FM flows from a left side to a right side of FIG. 3 in parallel to the longitudinal axis Cp, i.e., in a direction toward the intake port outlet 6B.

As is apparent from FIG. 3, the first alignment direction A coincides with the direction toward the upstream side of the intake port 6 in parallel to the longitudinal axis Cp, and the second alignment direction B coincides with the direction toward the downstream side of the intake port 6 in parallel to the longitudinal axis Cp. Accordingly, the first plasma actuator 20A generates the first actuator airflow in the first alignment direction A (a predetermined direction) in an arbitrary point P at the time of its operation. Similarly, the second plasma actuator 20B generates the second actuator airflow in the second alignment direction B in the arbitrary point P at the time of its operation.

Returning to FIG. 1, the first and second plasma actuators 20A, 20B are laid substantially over the whole fuel adhesion region R having a curved cylindrical shape. Accordingly, the first and second plasma actuators 20A, 20B also have curved cylindrical shapes over the whole circumference of the inner wall surface 6A of the intake port 6.

Figure 4:
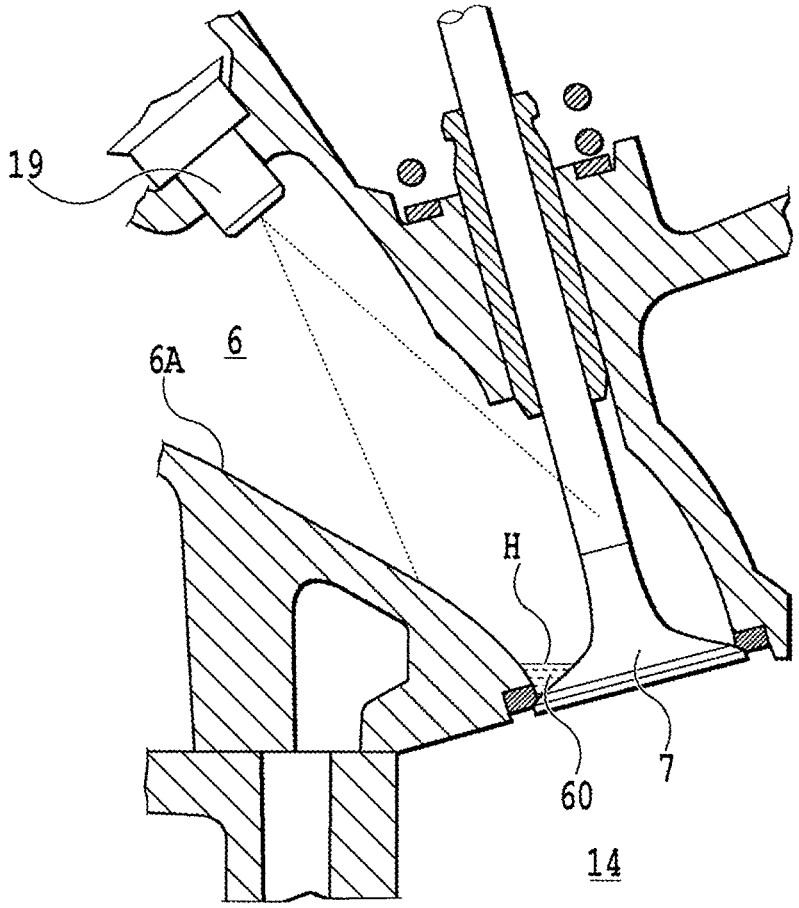
FIG. 4 is a schematic cross-sectional view showing fuel accumulated in a concave portion.

Now, as mentioned above, fuel injection from the fuel injection valve 19 is usually started during valve closing before valve opening of the intake valve 7 in order to promote vaporization of injected fuel. In that case, the fuel H injected from the fuel injection valve 19 to collide against or adhere to the intake port inner wall surface 6A tends to flow down along the intake port inner wall surface 6A, and to eventually accumulate in a concave portion 60 formed by being sandwiched between the intake port inner wall surface 6A and the intake valve 7 as shown in FIG. 4. Note that FIG. 4 shows a general configuration without the first and second plasma actuators 20A, 20B.

The accumulated fuel H flows down and flows into the combustion chamber 14 in a cylinder at once at the time of valve opening of the intake valve 7. Accordingly, there is a problem that the fuel having become comparatively large droplets vaporizes in the combustion chamber 14, and thus vaporization of the fuel is delayed, and as a result, much HC as unburned fuel is discharged.

This is particularly remarkable at the time of cold operation of the engine. It is because at the time of cold operation, temperatures of the intake port inner wall surface 6A and the intake valve 7 are low, and because vaporization of adhesion fuel by receiving heat from the intake port inner wall surface 6A and the intake valve 7 is apt to be insufficient. Note that since a fuel injection amount is more increased at the time of cold operation compared with the time of warm operation, the increased amount also causes delay in fuel vaporization.

Figure 5:
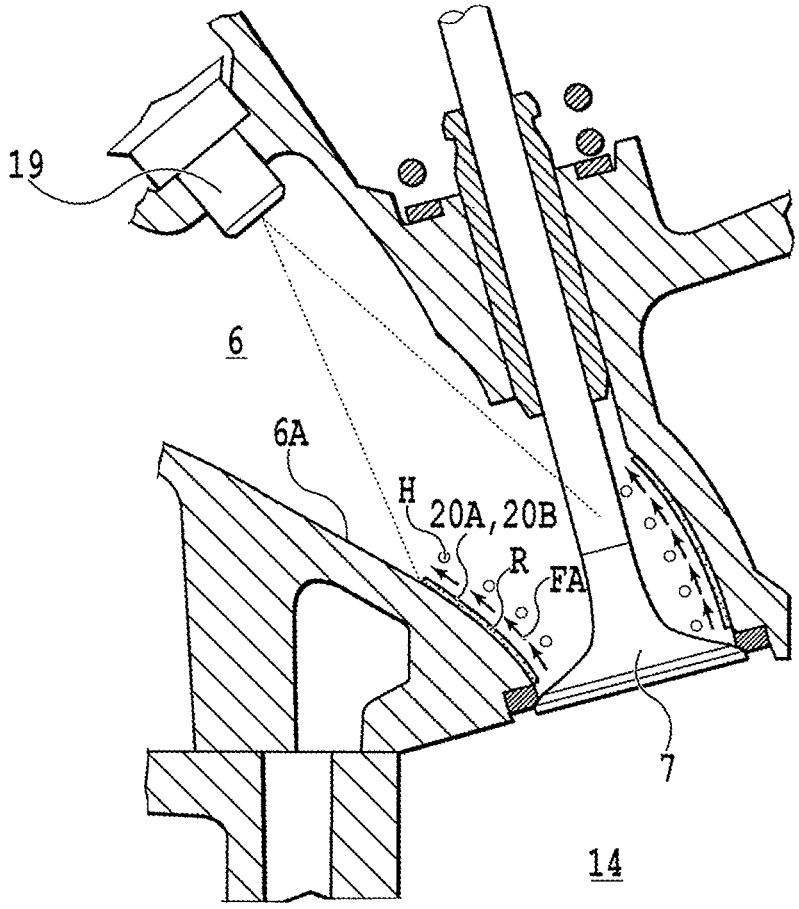
FIG. 5 is a schematic cross-sectional view showing appearance at the time of operation of a first plasma actuator.

However, the problem can be solved according to the embodiment. Namely, as shown in FIG. 5, in the embodiment, the ECU 100 controls the first plasma actuator 20A so as to actuate the first plasma actuator 20A until start of valve opening of the intake valve 7 from start of fuel injection by the fuel injection valve 19. In that case, the first actuator airflow FA in the first alignment direction A toward the upstream side of the intake port 6 is generated on a surface of the first plasma actuator 20A. The fuel H injected from the fuel injection valve 19 to collide against or adhere onto the surface of the first plasma actuator 20A is made to flow backward toward the upstream side of the intake port 6, or is held at its adhesion position, or is prevented from flowing down toward the downstream side of the intake port 6 by the first actuator airflow FA. After all, the adhesion fuel H is prevented from going to the downstream side of the intake port. As a result of this, fuel accumulation in the concave portion 60 is prevented from being generated, and even at the time of subsequent valve opening of the intake valve 7, flowing of the fuel having become comparatively large droplets into the combustion chamber 14, and not only delay in fuel vaporization due to the flowing, but discharge of HC are prevented.

In addition, the adhesion fuel H is maintained in a state of spreading on the surface of the first plasma actuator 20A in a state of small droplets. Accordingly, vaporization of the adhesion fuel H by receiving heat from the intake port inner wall surface 6A through the first plasma actuator 20A is promoted.

In addition, since the first actuator airflow FA includes plasma or ions, the adhesion fuel is reformed into a more combustible state by the plasma or the ions while being held etc. by the first actuator airflow FA. Accordingly, even when the adhesion fuel flows into the combustion chamber 14 at the time of subsequent valve opening of the intake valve, combustion of the adhesion fuel is promoted, and discharge of HC is suppressed.

Such operation or control of the first plasma actuator 20A is preferably performed at the time of cold operation of the engine. By doing this, an HC discharge amount that is apt to be increased at the time of cold operation of the engine can be suppressed.

When valve opening of the intake valve 7 is started after start of the operation of the first plasma actuator 20A, operation of the first plasma actuator 20A is stopped. This alone allows the adhesion fuel held etc. to flow into the combustion chamber 14 while being carried by the flow of the intake air. However, in the embodiment, the adhesion fuel is made to flow into the combustion chamber 14 more positively using the second plasma actuator 20B.

Figure 6:
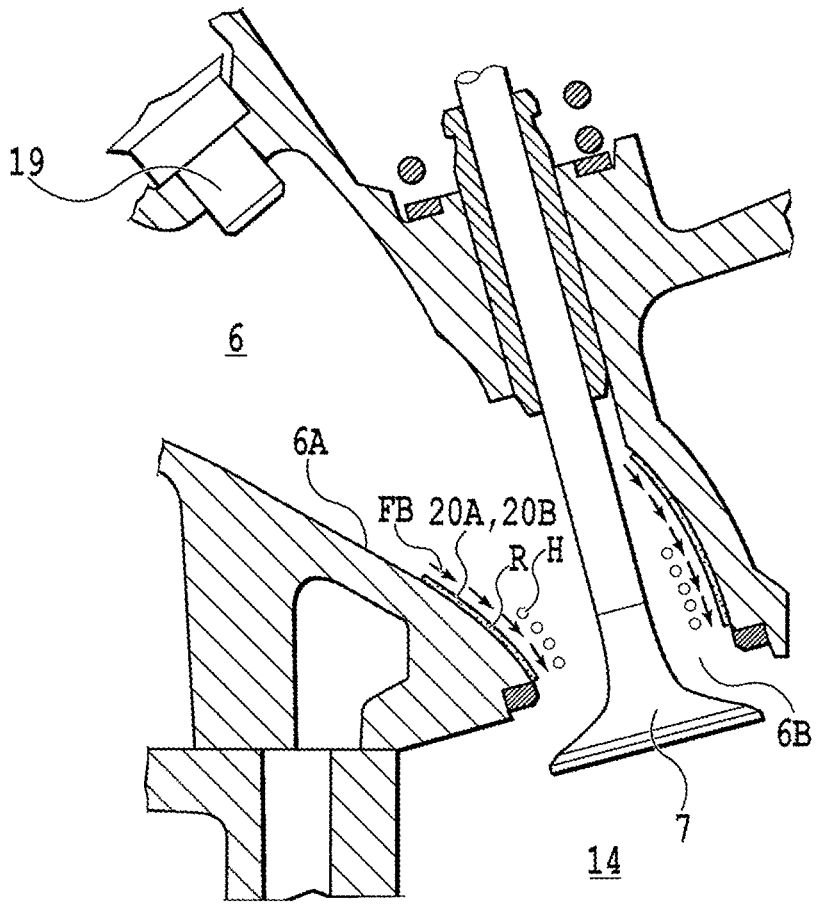
FIG. 6 is a schematic cross-sectional view showing appearance at the time of operation of a second plasma actuator.

Namely, the ECU 100 controls the first and second plasma actuators 20A, 20B so as to stop operation of the first plasma actuator 20A and so as to start operation of the second plasma actuator 20B at the time of start of the valve opening of the intake valve 7. In that case, as shown in FIG. 6, the second actuator airflow FB in the second alignment direction B toward the downstream side of the intake port 6 is generated on a surface of the second plasma actuator 20B. The adhesion fuel H on the surface of the plasma actuator is then made to flow toward the downstream side of the intake port 6 by the second actuator airflow FB. This makes it possible to send the adhesion fuel H to the downstream side more positively, to prevent the adhesion fuel H from remaining in the intake port 6, and to discharge the adhesion fuel H effectively to the combustion chamber 14.

Furthermore, since the second back surface electrode 22B is added to the first plasma actuator 20A, and the second plasma actuator 20B is integrally configured with the first plasma actuator 20A, there is an advantage that the above-described operational effect can be obtained by simple structural change.

Specific contents of control of the embodiment will be explained with reference to FIG. 7. When a crank angle detected by the crank angle sensor 41 becomes predetermined injection start timing (t1), the ECU 100 transmits an injection command signal to the fuel injection valve 19, so that fuel injection by the fuel injection valve 19 starts.

Simultaneously with this, the ECU 100 starts operation of the first plasma actuator 20A. Specifically, the ECU 100 switches the switch 32 shown in FIG. 2 from an off state to a state of actuating only the first plasma actuator 20A. As a result of this, adhesion fuel can be prevented from going to the downstream side as mentioned above. The ECU 100 continues this state until valve opening start timing t2 of the intake valve 7.

Simultaneously when the crank angle detected by the crank angle sensor 41 becomes the predetermined valve opening start timing (t2) of the intake valve, the ECU 100 stops operation of the first plasma actuator 20A, and starts operation of the second plasma actuator 20B. Specifically, the ECU 100 switches the switch 32 shown in FIG. 2 from the state of actuating only the first plasma actuator 20A to a state of actuating only the second plasma actuator 20B. As a result of this, the adhesion fuel can be sent positively toward the downstream side as mentioned above.

In an illustrated example, fuel injection is continuously executed even after the start of valve opening of the intake valve 7, and so-called synchronous injection is executed. In addition, fuel injection is ended at timing t3 before valve opening end timing (valve closing timing) t5 of the intake valve 7.

Simultaneously when the predetermined injection end timing (t3) is reached, the ECU 100 stops transmission of the injection command signal to the fuel injection valve 19 to thereby stop the fuel injection by the fuel injection valve 19. The ECU 100 then stops operation of the second plasma actuator 20B at timing t4 after elapse of a predetermined delay time from the fuel injection stop timing t3. Specifically, the ECU 100 switches the switch 32 shown in FIG. 2 to an off state of actuating neither of the plasma actuators. In the illustrated example, the intake valve 7 is closed after the stop of operation of the second plasma actuator 20B (t5).

Here, it is also preferable to execute the above-mentioned operation or control only at the time of cold operation of the engine. In this case, determination of whether or not the engine is under cold operation can be executed by the ECU 100 based on a water temperature detected by the water temperature sensor 42, for example. Specifically, the ECU 100 can determine that the engine is under cold operation on the basis of the fact that the water temperature detected by the water temperature sensor 42 is less than a predetermined water temperature.

Note that a case can also be considered where fuel injection is ended before the start of valve opening (at the time of valve closing) of the intake valve 7 (refer to a dashed line a). In this case as well, similarly to the above, the first plasma actuator 20A is made to operate until the start of valve opening of the intake valve 7, and simultaneously with the start of valve opening of the intake valve 7, operation of the first plasma actuator 20A is stopped, and operation of the second plasma actuator 20B is started.

Hereinbefore, although a basic practical example of the embodiment has been explained, the following modified example of the embodiment can also be carried out.

In the above-described basic practical example, although the first and second plasma actuators 20A, 20B are provided in the whole fuel adhesion region R and the whole circumference of the fuel adhesion region R, it is also possible to provide them partly in the fuel adhesion region R. Particularly, since the injected fuel directly collides against mainly the lower inner wall surface 6A of the intake port 6, it is possible to provide the first and second plasma actuators 20A, 20B only at a lower portion or a lower half portion of the fuel adhesion region R. When the first and second plasma actuators 20A, 20B are provided only at the lower half portion, they are formed in half-pipe shapes.

The first and second plasma actuators 20A, 20B may be dividedly configured instead of being integrally formed.

The second plasma actuator 20B may be omitted, and only the first plasma actuator 20A may be provided.

The first and second electrode units 24A, 24B may be aligned at unequal intervals, respectively.

Figure 7:
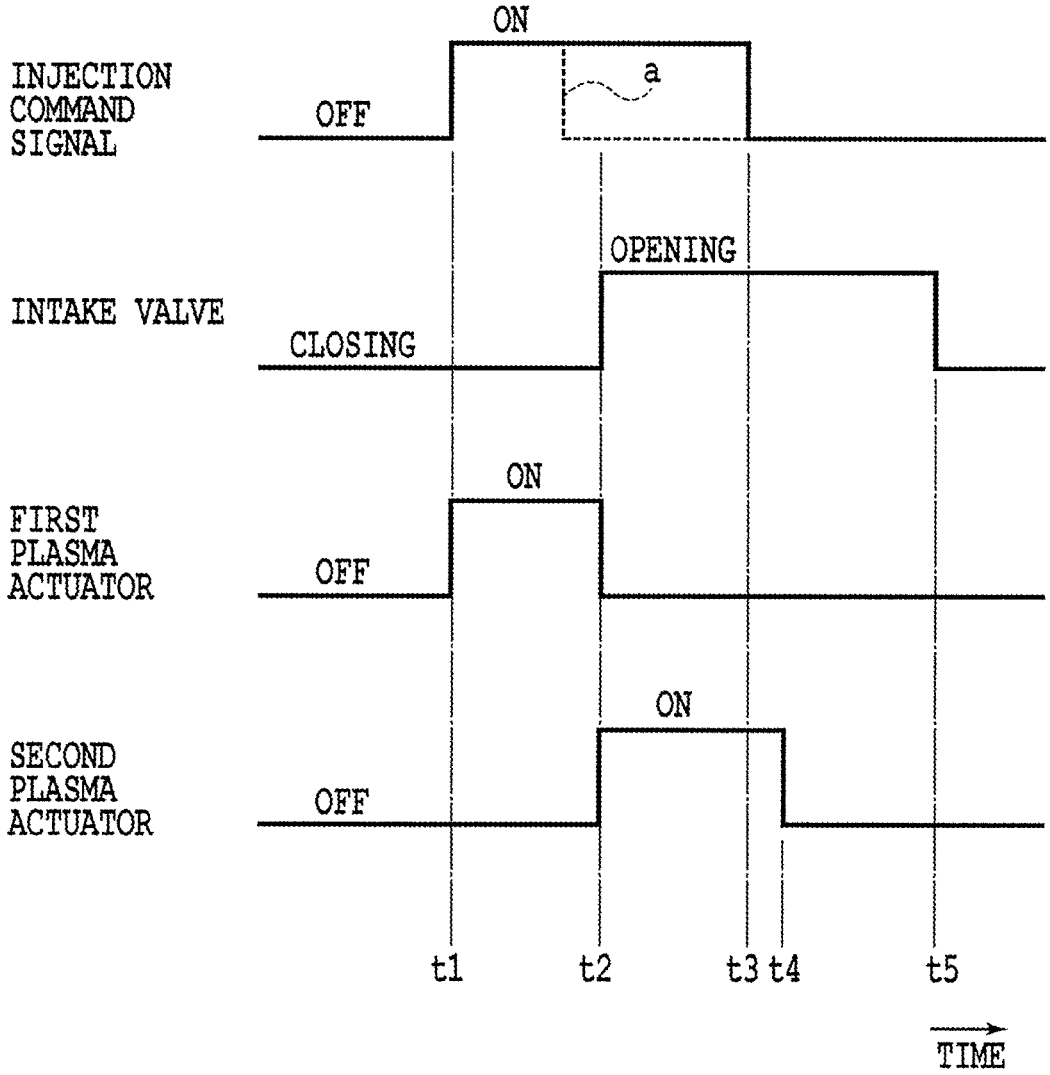
FIG. 7 is a time chart showing contents of control of the embodiment.

In the above-described basic practical example, as shown in FIG. 7, the first plasma actuator 20A is made to operate over a whole period from the start of fuel injection by the fuel injection valve 19 to the start of valve opening of the intake valve 7. This is because it is considered that an effect, such as the above-mentioned adhesion fuel holding, can be obtained at the maximum by thus making the first plasma actuator 20A operate. However, the first plasma actuator 20A may be made to operate for at least a part of the period from the start of fuel injection by the fuel injection valve 19 to the start of valve opening of the intake valve 7. This is because the effect, such as the above-mentioned adhesion fuel holding, can be obtained in at least the part of the period. Accordingly, operation start timing of the first plasma actuator 20A need not necessarily be the same as fuel injection start timing, and may be timing before the fuel injection start timing, or may be timing after the fuel injection start timing and before valve opening start timing of the intake valve. However, it is to be noted that electric power may be wastefully consumed in the former case, and that adhesion fuel injected before the start of operation of the first plasma actuator 20A may not be sufficiently held etc. in the latter case.

Similarly, operation stop timing of the first plasma actuator 20A need not necessarily also be the same as the valve opening start timing of the intake valve 7, and may be timing before the valve opening start timing of the intake valve, or may be timing after the valve opening start timing of the intake valve and before the valve opening end timing thereof. However, it is to be noted that the adhesion fuel holding, etc. may be unable to be sufficiently performed for a period from the stop of operation of the first plasma actuator 20A to the start of valve opening of the intake valve in the former case, and that intake of the adhesion fuel into the combustion chamber may be prevented in the latter case. Of course, it is considered that the latter case has the few above-described disadvantages since adhesion fuel can be forcibly taken in by the flow of the intake air.

The operation start timing of the second plasma actuator 20B can also be changed, and can preferably be changed in accordance with the operation stop timing of the first plasma actuator 20A. The operation start timing of the second plasma actuator 20B may be timing before the valve opening start timing of the intake valve, or can be set as timing after the valve opening start timing of the intake valve and before the valve opening end timing thereof. Although the operation start timing of the second plasma actuator 20B is preferably made to coincide with the operation stop timing of the first plasma actuator 20A, it is not necessarily made to coincide therewith and, for example, can also be set as timing delayed more than the operation stop timing of the first plasma actuator 20A.

Next, other embodiments of the present invention will be explained. Note that the same symbols are attached to portions similar to the first embodiment in the drawings, explanations of the portions will be omitted, and that differences will be mainly explained.

Second Embodiment

Figure 8:
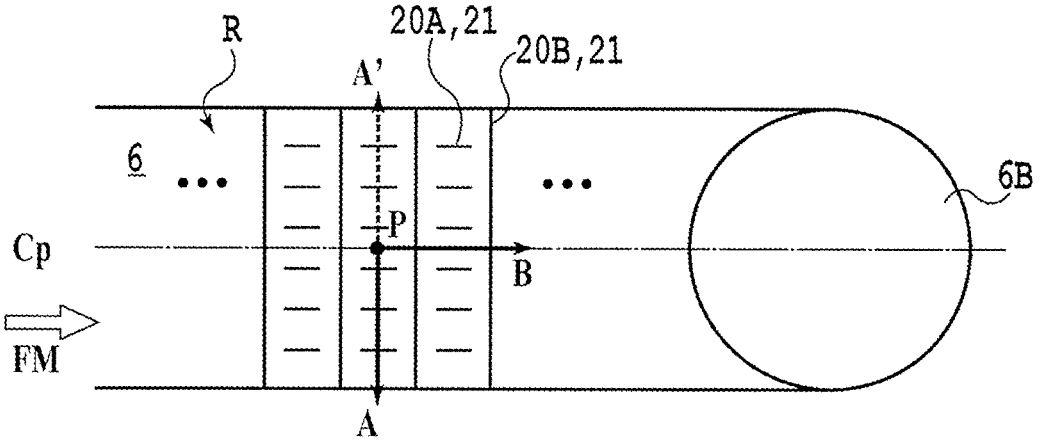
FIG. 8 is a schematic development view showing a configuration of a second embodiment.

FIG. 8 is a schematic development view showing a configuration according to a second embodiment, and is the view similar to FIG. 3. As illustrated, the embodiment is similar to the first embodiment in points where each electrode is disposed at the common dielectric, and where the second alignment direction B is the direction toward the downstream side of the intake port 6. However, the embodiment is different from the first embodiment in a point where the first alignment direction A is the direction perpendicular to the longitudinal direction (longitudinal axis Cp) of the intake port 6, and along a circumferential direction of the inner wall surface 6A of the intake port 6.

Specifically, the second plasma actuator 20B is configured similarly to the first embodiment. On the other hand, the plurality of front surface electrodes 21 of the first plasma actuator 20A are formed separately from the front surface electrodes 21 of the second plasma actuator 20B, and are disposed between the front surface electrodes 21 of the second plasma actuator 20B with their direction being changed by 90° from the first embodiment. Accordingly, the front surface electrodes 21, 21 of the first and second plasma actuators 20A, 20B are disposed substantially in a lattice shape as illustrated when seen as a whole. The plurality of front surface electrodes 21 of the first plasma actuator 20A is made to be shorter, and are aligned between the respective front surface electrodes 21 of the second plasma actuator 20B along the first alignment direction A. Note that although not illustrated, in the first plasma actuator 20A, the plurality of first back surface electrodes 22A are also aligned keeping a relation offset in the first alignment direction A from the front surface electrodes 21.

In the embodiment, these first and second plasma actuators 20A, 20B are provided only in the lower half portion of the fuel adhesion region R, and accordingly, they are formed in half-pipe shapes.

In a case where the first plasma actuator 20A is configured and disposed as described above, when the first plasma actuator 20A is actuated, the first actuator airflow in the first alignment direction A is generated at an arbitrary point P on the surface of the first plasma actuator 20A. Adhesion fuel is given a drive force toward the circumferential direction of the intake port inner wall surface 6A by the first actuator airflow, and particularly, receives a drive force to cause a rise of the adhesion fuel in the circumferential direction along the intake port inner wall surface 6A. Also as a result of this, the adhesion fuel is prevented from going to the downstream side of the intake port, and an operational effect similar to the first embodiment can be obtained.

Note that the first alignment direction may be set as an A' direction (shown by a dashed line) opposite to the A direction (shown by a continuous line). In addition, the first alignment direction may be separated into the A direction and the A' direction with a lowest position of the first plasma actuator 20A as a boundary.

On the contrary to an illustrated example, the front surface electrodes 21 (and the second back surface electrodes 22B) of the second plasma actuator 20B are shortened to be disposed between the respective front surface electrodes 21 of the first plasma actuator 20A (and between the first back surface electrodes 22A), while the front surface electrodes 21 (and the first back surface electrodes 22A) of the first plasma actuator 20A are extended long in the direction of the longitudinal axis Cp, whereby they may be formed substantially in a lattice shape as a whole.

A control method of the embodiment is similar to that of the first embodiment.

Third Embodiment

Figure 9:
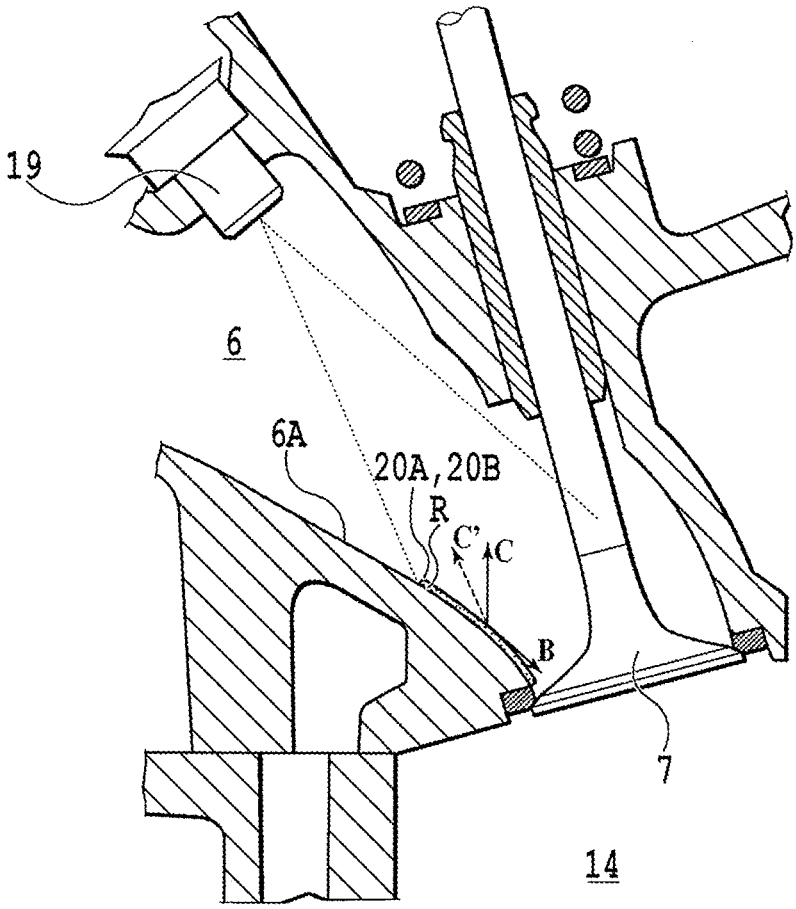
FIG. 9 is a schematic cross-sectional view showing a direction of an airflow generated in a third embodiment.

FIG. 9 is a schematic cross-sectional view showing a configuration according to a third embodiment. In the embodiment, the first and second plasma actuators 20A, 20B are provided only in the lower portion or near the lowest position of the fuel adhesion region R. Additionally, the configurations of the first and second plasma actuators 20A, 20B are similar to those of the first embodiment.

However, the embodiment is different from the first embodiment in a point where the direction of the actuator airflow generated for the period from start of fuel injection to start of valve opening of the intake valve is not the first alignment direction A but a vertical upward direction C as shown by a continuous line in FIG. 9.

Such an airflow in the direction C can be generated by actuating both the first and second plasma actuators 20A, 20B, and controlling magnitude of voltages applied to them, i.e., strength of the actuator airflows FA, FB generated therein. As shown in FIG. 2, for example, assume that a same voltage is applied to the first and second plasma actuators 20A, 20B. In that case, as shown by dashed lines in FIG. 2, the actuator airflows FA, FB that face each other and have same strength collide against each other, and are curved upward. As a result of this, an ascending airflow FC that vertically separates from the actuator surfaces is generated. The magnitude of the voltages applied to the respective plasma actuators 20A, 20B are changed, the strengths of the respective actuator airflows FA, FB are controlled, and thereby a direction of the ascending airflow FC can be changed.

Thus, the first and second plasma actuator 20A, 20B are controlled so that the ascending airflow in the vertical upward direction C as shown in FIG. 9 is generated. Note that at this time, in the power supply device 30, the power supply 31 is desirably altered so that different magnitude of voltage can be output from a different power supply provided for each plasma actuator, or so that a different voltage can be output from a common power supply to each plasma actuator. In addition, the switch 32 is desirably altered so that the voltage can be simultaneously applied to the both plasma actuators.

By such an ascending airflow, the adhesion fuel H can be held in a state of being floated above the first and second plasma actuators 20A, 20B. Also as a result of this, the adhesion fuel H is prevented from going to the downstream side of the intake port, and an operational effect similar to the first embodiment can be obtained.

Note that as shown by a dashed line in FIG. 9, a direction of the ascending airflow may be set as a direction C' inclined toward the upstream side of the intake port 6 with respect to the vertical upward direction C. If this is done, the floating adhesion fuel H can be biased toward the upstream side of the intake port 6, and the adhesion fuel H can be still more prevented from going to the downstream side of the intake port.

A control method of the embodiment is similar to that of the first embodiment except for a point of performing airflow control as described above.

[Generalization]

As is understood from the above explanations, the first plasma actuator 20A is disposed so as to generate, at the time of its operation, the first actuator airflow in the predetermined direction not including the component in the direction toward the downstream side of the intake port 6. This will be explained in more detail using FIG. 3. The first actuator airflow generated at the arbitrary point P on the first plasma actuator 20A can be decomposed into a component in a direction parallel to the longitudinal axis Cp and a component in a direction vertical thereto. The "component in the direction toward the downstream side of the intake port 6" means a component toward the downstream side of the intake port in parallel to the longitudinal axis Cp from the point P. Accordingly, the "first actuator airflow in the predetermined direction not including the component in the direction toward the downstream side of the intake port 6" means that the first actuator airflow does not include such a component. The airflow in the A or A' direction as shown in FIG. 8 is also included in the "first actuator airflow in the predetermined direction", not to mention the airflow in the A direction as shown in FIG. 3. Accordingly, the "first actuator airflow in the predetermined direction" may be an airflow in an oblique direction between the A direction of FIG. 3 and the A or AT direction of FIG. 8. Conversely, the airflow in the B direction shown in FIG. 3 apparently includes the "component in the direction toward the downstream side of the intake port 6", and does not correspond to the "first actuator airflow in the predetermined direction". Similarly to these airflows, the ascending airflow in the C or C' direction generated by operation of both of the first and second plasma actuators 20A, 20B as shown in FIG. 9 is also an airflow that can prevent the adhesion fuel from going to the downstream side of the intake port.

Hereinbefore, although the preferred embodiments of the present invention have been explained, still other embodiments can be employed in the present invention.

The above-described each embodiment, each practical example, and each configuration can be arbitrarily combined with each other unless inconsistency occurs. All modification examples, application examples, and equivalents that are embraced in the concept of the present invention prescribed by claims are included in the embodiments of the present invention. Accordingly, the present invention should not be restrictively construed, and can be applied also to other arbitrary technologies that belong within the scope of the concept of the present invention.

What is claimed is:

1. An intake system of an internal combustion engine comprising:

a fuel injection valve that injects fuel to an intake passage;

a plasma actuator provided in a region which is on an inner wall surface of the intake passage and to which the fuel injected from the fuel injection valve adheres; and a control unit configured to control the plasma actuator, wherein the plasma actuator is disposed so as to generate an airflow in a predetermined direction not including a component in a direction toward a downstream side of the intake passage at the time of its operation, and wherein the control unit controls the plasma actuator so as to actuate the plasma actuator in at least a part of a period from start of fuel injection by the fuel injection valve to start of valve opening of an intake valve.

2. The intake system of the internal combustion engine according to claim 1, wherein the control unit controls the plasma actuator so as to actuate the plasma actuator over the whole period from the start of fuel injection by the fuel injection valve to the start of valve opening of the intake valve.

3. The intake system of the internal combustion engine according to claim 1, further comprising a second plasma actuator in the region in addition to a first plasma actuator provided so as to generate the airflow in the predetermined direction at the time of operation, wherein the second plasma actuator is disposed so as to generate a second airflow in a direction toward the downstream side of the intake passage at the time of its operation, and wherein the control unit controls the first and second plasma actuators so as to stop the operation of the first plasma actuator and so as to start the operation of the second plasma actuator on or after the start of valve opening and before the end of the valve opening of the intake valve.

4. The intake system of the internal combustion engine according to claim 3, further comprising:

a common power supply applying a voltage to the first and second plasma actuators; and a switch interposed between the first and second plasma actuators and the power supply, wherein the control unit switches operation states of the first and second plasma actuators by switching the switch.

5. The intake system of the internal combustion engine according to claim 3, wherein the first plasma actuator is configured to align in a first direction a plurality of electrode units each including a front surface electrode, a back surface electrode offset in the first direction with respect to the front surface electrode, and a dielectric disposed between the front surface electrode and back surface electrode, and wherein the first plasma actuator is disposed so that the first direction coincides with the predetermined direction.

6. The intake system of the internal combustion engine according to claim 1, comprising a first plasma actuator and a second plasma actuator in the region, wherein the first plasma actuator and the second plasma actuator are disposed so as to generate airflows that face each other by operation of both of them, thereby to make the airflows collide against each other.

* * * * *